United States Patent [19]

Buhl

[11] 4,142,484

[45] Mar. 6, 1979

[54] PISTON FOR INTERNAL COMBUSTION ENGINE

[75] Inventor: Hans W. Buhl, Stuttgart, Fed. Rep. of Germany

[73] Assignee: Daimler-Benz Aktiengesellschaft, Fed. Rep. of Germany

[21] Appl. No.: 719,580

[22] Filed: Sep. 1, 1976

[30] Foreign Application Priority Data

Sep. 5, 1975 [DE] Fed. Rep. of Germany ..... 2539470

[51] Int. Cl.[2] ..... F01P 1/04; F01P 3/06

[52] U.S. Cl. ..... 123/41.35; 92/159; 123/193 P

[58] Field of Search ..... 123/41.34, 41.35, 193 P, 123/193 CP; 92/158, 159; 184/6.5

[56] References Cited

U.S. PATENT DOCUMENTS

| | | | |
|---|---|---|---|
| 1,073,197 | 9/1913 | Westinghouse | 92/159 |
| 2,687,931 | 8/1954 | Flynn | 123/41.35 |
| 2,800,119 | 7/1957 | Schmidl | 123/41.35 |
| 3,056,638 | 10/1962 | Hovde | 123/193 P |
| 3,221,718 | 12/1965 | Isley | 123/41.35 |
| 4,011,797 | 3/1977 | Cornet | 123/193 P |

FOREIGN PATENT DOCUMENTS

| | | | |
|---|---|---|---|
| 449069 | 8/1927 | Fed. Rep. of Germany | 123/41.35 |
| 1029617 | 3/1958 | Fed. Rep. of Germany | 123/41.35 |

*Primary Examiner*—Charles J. Myhre
*Assistant Examiner*—Craig R. Feinberg
*Attorney, Agent, or Firm*—Craig & Antonelli

[57] ABSTRACT

A piston for internal combustion engines which is cooled by means of splash oil, and in which the piston interior space is closed off by a collecting trough arranged at the lower end of the piston and provided with an opening for the passage of the connecting rod.

25 Claims, 8 Drawing Figures

FIG 7
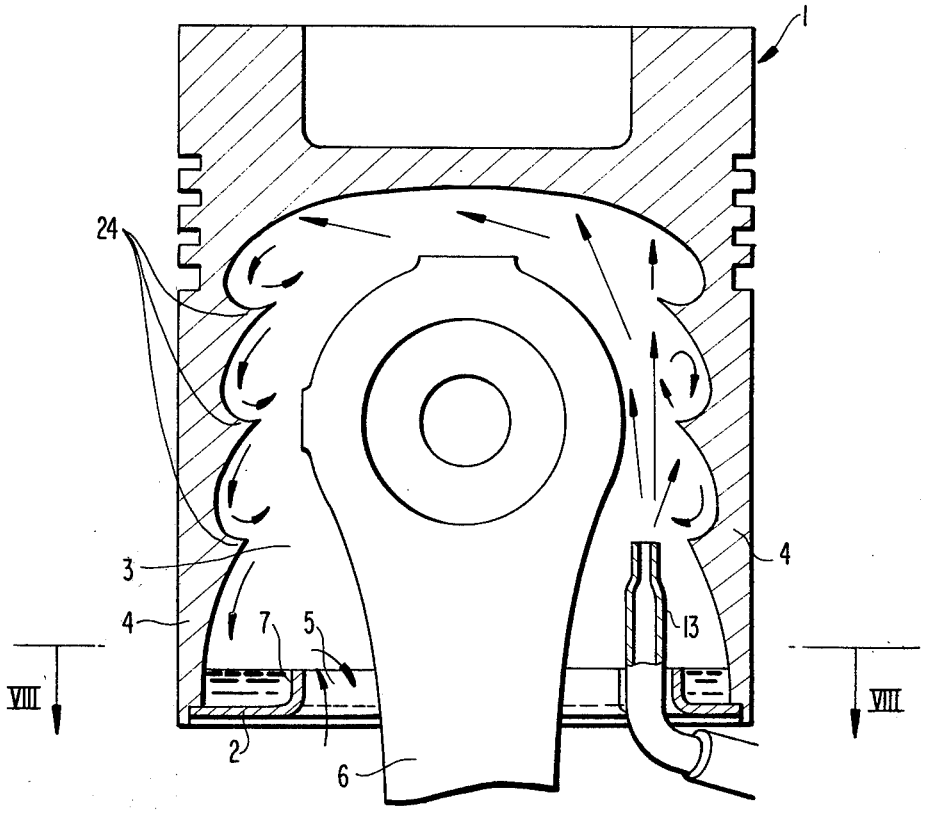
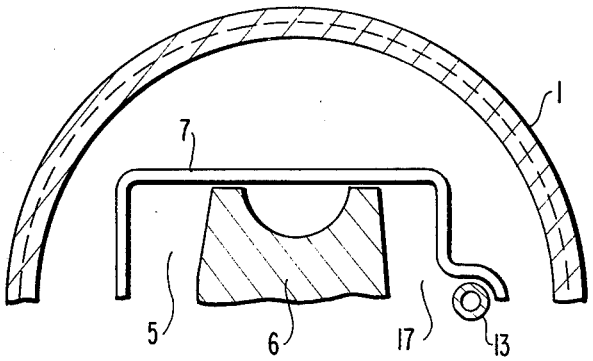
FIG 8

PISTON FOR INTERNAL COMBUSTION ENGINE

The present invention relates to a piston for internal combustion engines which is cooled by means of splash oil.

In known types of construction, a piston cooling takes place by a cooling-oil splashing system splashing cooling oil discharged from a nozzle against the inner piston contour or in case of particularly highly loaded plunger-piston internal combustion engines by a forced-oil-cooling system.

The cooling effects are good in both systems, however, the splashing of the piston inner contour with cooling oil is utilizable only for an increase of the power density (for example, by supercharging) of the order of magnitude up to about 35%, whereas larger specific power outputs require a forced-oil-cooling system involving very high costs.

The present invention is therefore concerned with the task to so improve the free piston oil-splashing system with slight expenditures that approximately the effect of a forced-oil-cooling system for the piston is attained.

The underlying problems are solved according to the present invention in that the interior space of the piston is closed off by a collecting trough arranged at the lower end of the piston and provided with an opening for the passage therethrough of the connecting rod.

A shaker space, so to speak of, results in the piston from the arrangement of the collecting trough, in which the cooling takes place by the shaker action or by the oil displaced in the shaker space by inertia forces. The intensive oil movements lead to high heat transfer coefficients and consequently to a favorable cooling effect.

Provision is made as additional feature in accordance with the present invention that for purposes of feeding cooling oil the connecting rod is provided with channels including at least one nozzle arranged at the connecting rod head, whereby the nozzle axis or axes are directed against the piston top with a non-deflected connecting rod.

The location of one or several nozzles can be so chosen that the sprayed-off cooling oil at first impinges against the thermally critical areas.

In lieu of the aforementioned embodiment, a nozzle may be fixedly mounted at the crankcase and the opening for the connecting rod may simultaneously also be an opening for the nozzle or an additional opening may be provided for the nozzle in the collecting trough, whereby the oil jet passing through the one or the other opening impinges on the piston top so that a point-shaped impingement of the cooling oil results at the piston top.

In order to be able to economize the costs for a separate forced lubrication system for the wrist pin in case of connecting rod loads which are not too high, feed channels for the wrist pin lubrication may be arranged in the upper half of the connecting rod head.

In a preferred embodiment of the present invention, the transitional area from the piston top to the piston skirt may be so constructed for purposes of an intensification of the heat removal that the contour of the interior space of the piston is drawn up to the height of the piston ring grooves and that the inner circumference of the piston skirt is provided with ribs extending in the piston axis.

For the further assist of the cooling effect as well as for the increase of the heat transfer coefficients, provision is made according to the present invention that the piston skirt is provided in the piston interior space with several ring-shaped oil pockets arranged one above the other for the temporary collection of cooling oil.

In order to be able to partially cool off immediately the relatively hot cooling oil after leaving the shaker space at the comparatively cold cylinder walls, it is proposed that the collecting trough is provided at the outer circumference with openings for the intentional, aimed-at impingement of the oil on the cylinder wall.

As a further feature of the present invention, the collecting trough may be either rigidly connected with the piston skirt or may be secured on lugs or brackets retained by the piston wrist pin.

Accordingly, it is an object of the present invention to provide a piston for internal combustion engines which avoids by simple means the aforementioned shortcomings and drawbacks encountered in the prior art.

Another object of the present invention resides in a reciprocating piston for internal combustion engines which assures an intensive cooling of the piston, yet avoids excessive costs for its cooling system.

A further object of the present invention resides in a cooling system for pistons of internal combustion engines by means of splash oil which achieves at least approximately the effect of a forced-oil-cooling system, yet dispenses with the structural expenditures involved in connection therewith.

Still a further object of the present invention resides in a piston for internal combustion engines with an oil cooling system that assures high heat transfer coefficients and consequently favorable cooling effects.

Another object of the present invention resides in an oil cooling system for reciprocating pistons of internal combustion engines in which a separate, forced lubrication system for the wrist pin can be economized.

A further object of the present invention resides in a piston for internal combustion engines of the type described above in which the heated cooling oil can be cooled again immediately by passing it over cooler cylinder walls.

These and other objects, features and advantages of the present invention will become more apparent from the following description when taken in connection with the accompanying drawing, which shows, for purposes of illustration only, several embodiments in accordance with the present invention, and wherein:

FIGS. 6 and 7 are respectively axial longitudinal cross-sectional views through two still further modified embodiments of a piston in accordance with the present invention; and FIG. 8 is a cross-sectional view through the piston taken along line VIII—VIII in FIG. 7.

Figure 1:
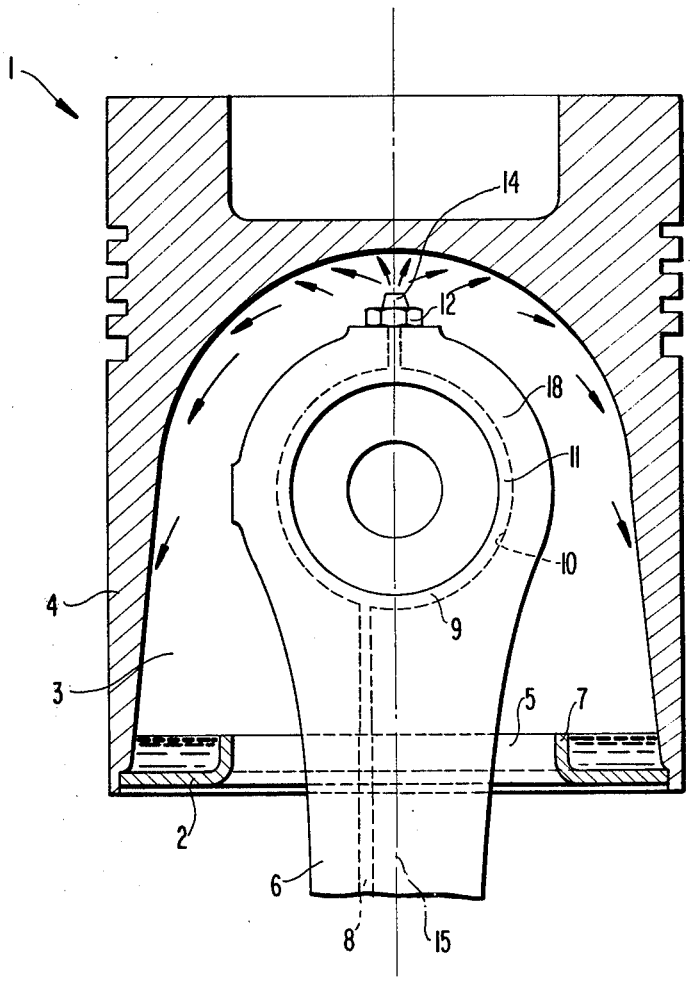
FIG. 1 is an axial longitudinal cross-sectional view through a piston with a collecting trough in accordance with the present invention.

Referring now to the drawing wherein like reference numerals are used throughout the various views to designate like parts, a piston generally designated by reference numeral 1 for a reciprocating piston internal combustion engine is provided according to FIGS. 1 to 8 at its lower end with a collecting trough 2 for collecting the cooling oil, which trough closes off partially the piston interior space 3.

The collecting trough 2 may consist of sheet metal, synthetic resinous material or aluminum die-casting of flat, ribbed, grooved or flanged construction and may be welded-on, glued-in, pressed-in, screwed-on or screwed into the piston skirt 4.

The collecting trough 2 includes a rectangular opening 5 for the passage of a connecting rod 6, whereby the opening 5 includes an edge 7 or flange drawn up into the piston interior space 3, over which flows off the cooling oil collected in the collecting trough 2. The height of the edge 7 or of the flange at the opening 5 is determinative for the filling degree in the piston interior space 3.

The oil supply takes place by way of a riser bore 8 in the connecting rod 6 and by way of an annular groove 9 in the connecting rod bush 10, to a nozzle 12 (FIG. 1) arranged centrally at the connecting rod boss 11.

Figure 4:
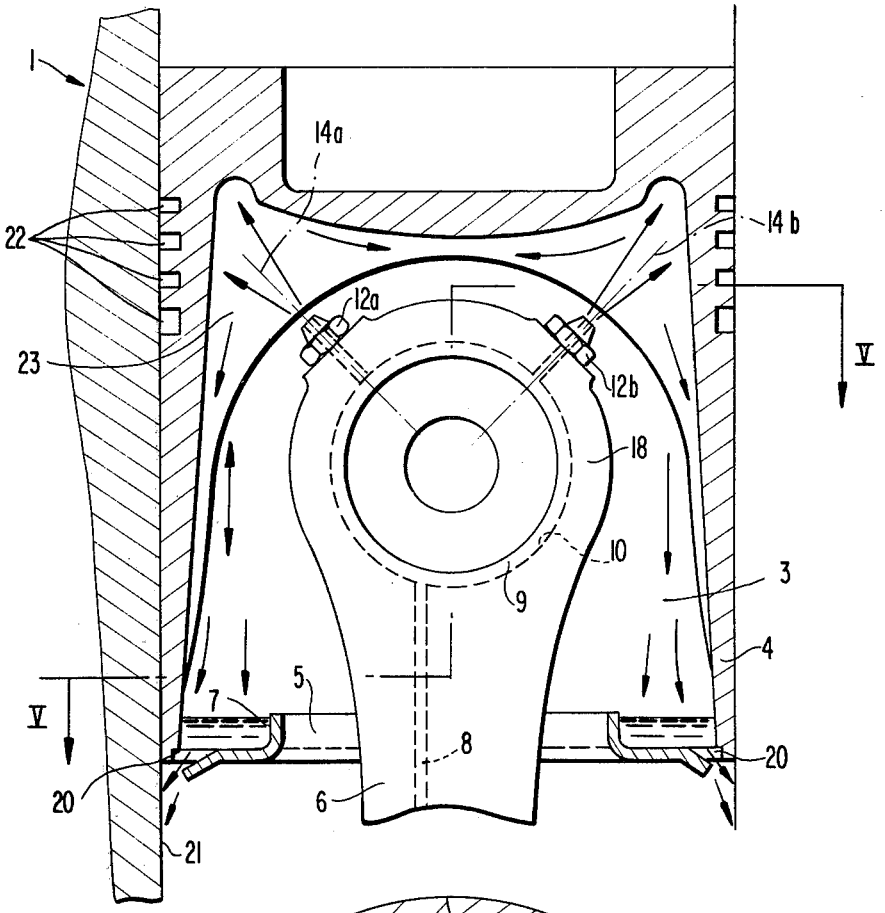
FIG. 4 is an axial longitudinal cross-sectional view through a still further modified embodiment of a piston with a collecting trough in accordance with the present invention.

In case the zones to be cooled are locateed primarily offset to the piston top center, the nozzle 12 may also be arranged eccentrically or, according to FIG. 4, several nozzles **12*a* and 12*b* may be provided. The pivot angle of the connecting rod 6** and the jet lengths determine the jet impingement areas.

Figure 6:
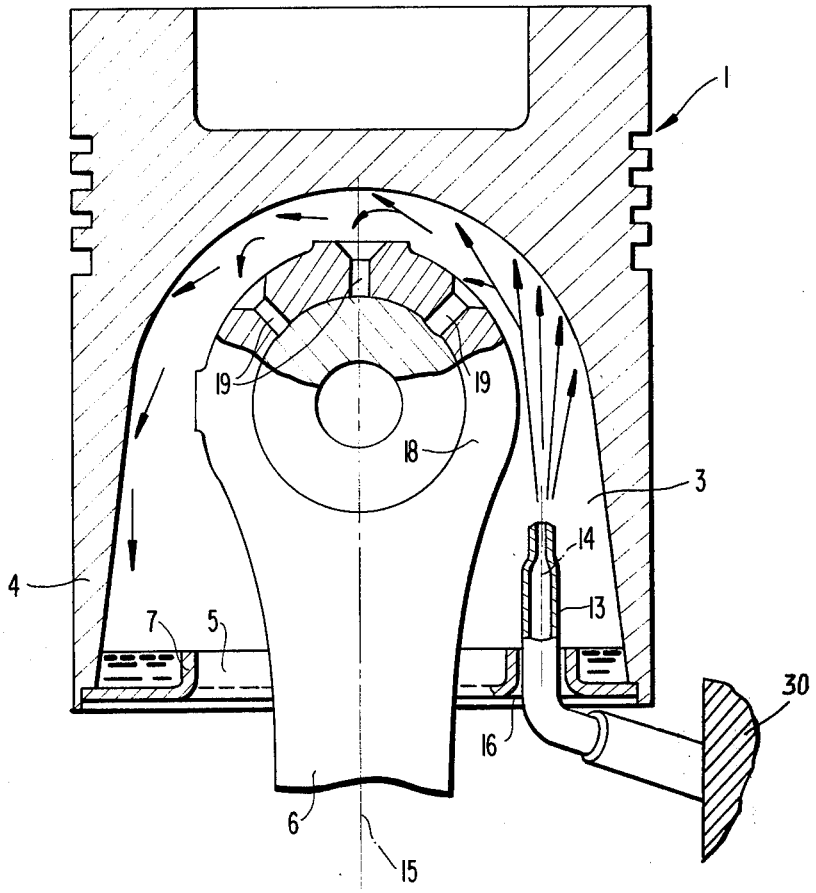

The oil feed illustrated in FIG. 6 is achieved by way of a nozzle 13 fixedly mounted at the crankcase 30, whose axis 14 extends parallel to the piston or cylinder axis 15. in this case, a point-shaped impingement of the cooling oil at the piston inner contour will also result. In case the impingement area is too small, the axis 14 of the nozzle 13 may be arranged at an acute angle to the cylinder axis 15.

In addition to the rectangular opening 5 for the connecting rod 6, a further around opening 16 for the nozzle 13 is provided (FIG. 6). In lieu of the round opening 16 of FIG. 6, the rectangularly constructed opening 5 in the collecting trough 2 may be provided according to FIGS. 7 and 8 with a recess 17 matched to the nozzle shape.

With the arrangement of a nozzle 13, the oil supply in the piston interior space 3 is so plentiful as a result of the influence of the collecting trough 2 that a forced lubrication system for the wrist pin, otherwise customary, may be dispensed with. The wrist pin lubrication now takes place by the oil present in the piston interior space which reaches the lubricating places by way of funnel-shaped feed channels 19 arranged in the connecting rod head 18 as shown in FIG. 6.

Figure 5:
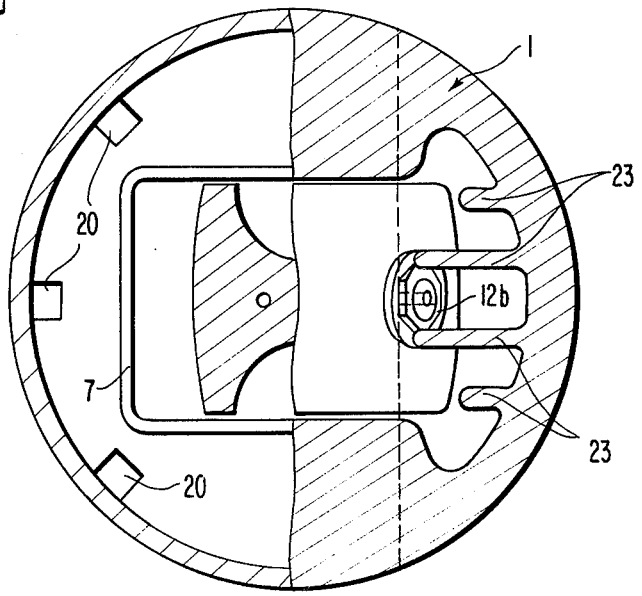
FIG. 5 is a cross-sectional view through the piston taken along line V—V in FIG. 4.

According to FIGS. 4 and 5, openings 20 are provided at the outer circumference of the collecting trough 2, by way of which the hot oil is ejected or discharged by the inertia forces in the direction toward the cylinder wall 20. In addition to the re-cooling effect as a result of the oil cooling off at the cool cylinder walls, optimum operating and running conditions for the piston, pistons rings, and cylinder bore are achieved thereby. Furthermore, a uniform oil distribution over the cylinder circumference is possible with the aid of these openings 21.

The piston interior space 3 is so constructed according to FIGS. 4 and 5 that the inner contour is drawn up to the height of the piston ring grooves 22. Ribs 23 extend from the lower area of the piston skirt 4 to the piston top.

Another ribbed construction of the piston interior space 3 is shown in FIG. 7. In this embodiment, several ring-shaped ribs 24 arranged one above the other and constructed as oil pockets extend along the inner circumference of the piston skirt 4 and serve to assist the cooling effect — as in connection with the aforedescribed embodiment according to FIG. 4.

Figure 2:
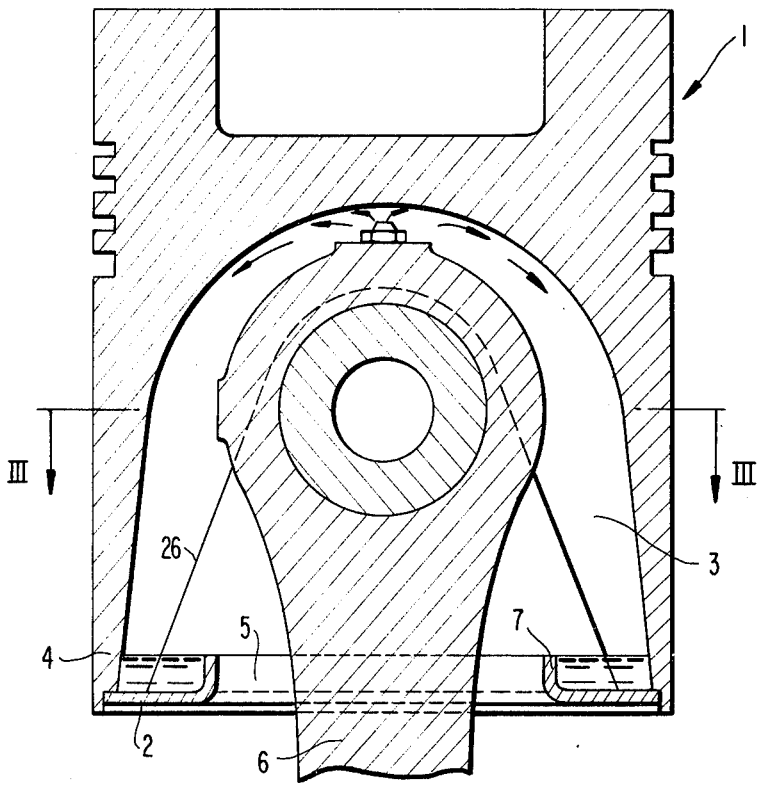
FIG. 2 is a cross-sectional view through a modified embodiment of a piston in accordance with the present invention, taken along line II—II in FIG. 3.
Figure 3:
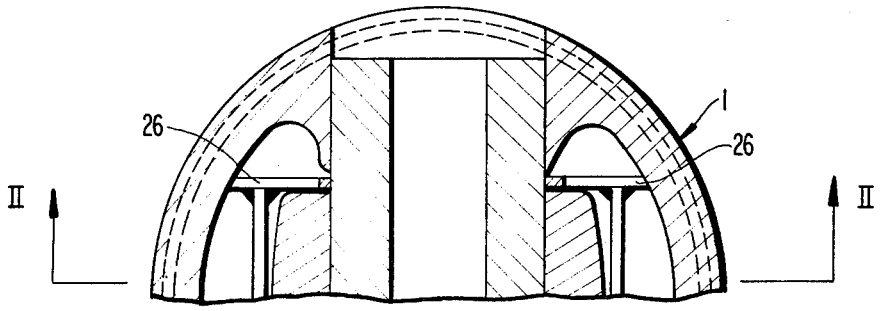
FIG. 3 is a cross-sectional view through the piston taken along line III—III in FIG. 2.

In addition to the types of fastening of the collecting trough 2 described hereinabove, a fastening is used according to FIGS. 2 and 3 in which the collecting trough 2 fitted into the piston skirt 4 is retained in its position by two lugs or brackets 26. The lugs or brackets 26 are slipped over the wrist pin and placed between the connecting rod head and the wrist pin boss of the piston 1.

Appropriately, the cross section of the opening 5 is constructed so large that the connecting rod 6 just barely still passes freely therethrough, taking into consideration the maximum connecting rod deflection angle.

While I have shown and described several embodiments in accordance with the present invention, it is understood that the same is not limited thereto but is susceptible of numerous changes and modifications as known to those skilled in the art, and I therefore do not wish to be limited to the details shown and described herein but intend to cover all such changes and modifications as are encompassed by the scope of the appended claims.

I claim:

1. A piston for internal combustion engines cooled by means of splash oil comprising:

a piston skirt having an inner surface defining an interior space having an arcuately curved upper end;

a connecting rod attached to said piston skirt within said interior space and having an upper end portion located within the arcuately curved upper end of said interior space;

collecting trough means having an opening for passage of said connecting rod and arranged at the lower end of said piston skirt at least partially closing off said interior space; and supplying means for directing a spray of cooling oil into said interior space wherein it is distributed by said arcuately curved upper end, and wherein said connecting rod is provided with feed channel means formed by a plurality of funnel-shaped inlet passages comprising a cone-shaped mouth leading to a cylindrical tubular section located in the upper end portion of said connecting rod for receiving cooling oil supplied by said supply means into the upper end of said interior space for directing it from said interior space into the connecting rod so as to provide wrist pin lubrication of an upper portion thereof.

2. A piston according to claim 1, characterized in that the collecting trough means is rigidly connected with the piston skirt.

3. A piston according to claim 1, characterized in that the collecting trough means is secured at lug means retained by the piston wrist pin.

4. A piston according to claim 1, wherein said inner surface of said piston skirt is provided with at least one ring-shaped rib forming at least one oil pocket.

5. A piston according to claim 1, wherein said collecting trough means is provided with openings at its outer circumference for an aimed-at application of the oil collected in the collecting trough means against a wall of a cylinder.

6. A piston according to claim 5, wherein said inner surface of said piston skirt is provided with at least one ring-shaped rib forming at least one oil pocket.

7. A piston according to claim 1, characterized in that the contour of the piston interior space is drawn up to the height of the piston ring grooves and in that the inner circumference of the piston skirt is provided with ribs extending substantially in the piston axis.

8. A piston according to claim 7, characterized in that the collecting trough means is rigidly connected with the piston skirt.

9. A piston according to claim 7, characterized in that the collecting trough means is secured at lug means retained by the piston wrist pin.

10. A piston according to claim 1, characterized in that the inner circumference of the piston skirt is provided with several ring-shaped oil pockets arranged one above the other for the temporary collection of cooling oil.

11. A piston according to claim 10, characterized in that the collecting trough means is rigidly connected with the piston skirt.

12. A piston according to claim 10, characterized in that the collecting trough means is secured at lug means retained by the piston wrist pin.

13. A piston according to claim 1, characterized in that the supply means is a nozzle fixedly mounted at a crankcase of the engine.

14. A piston according to claim 13, characterized in that the opening for the connecting rod simultaneously serves as opening for the nozzle.

15. A piston according to claim 13, characterized in that an additional opening is provided for the nozzle in the collecting trough means.

16. A piston according to claim 13, characterized in that said feed channels for a wrist pin lubrication are arranged in the upper half of the connecting rod head.

17. A piston according to claim 13, characterized in that the oil jet of the oil flow passing through the opening and discharged through the nozzle impinges against the piston top.

18. A piston according to claim 17, characterized in that feed channels for a wrist pin lubrication are arranged in the upper half of the connecting rod head.

19. A piston according to claim 18, characterized in that the contour of the piston interior space is drawn up to the height of the piston ring grooves and in that the inner circumference of the piston skirt is provided with ribs extending substantially in the piston axis.

20. A piston according to claim 18, characterized in that the inner circumference of the piston skirt is provided with several ring-shaped oil pockets arranged one above the other for the temporary collection of cooling oil.

21. A piston according to claim 18, characterized in that the collecting trough means is provided at the outer circumference thereof with openings for an aimed-at application of the hot oil collected in the trough means against the cylinder wall.

22. A piston according to claim 1, wherein said supplying means directs said cooling oil into contact with said interior surface from which at least part of said oil flows to said trough, said trough being constructed so as to permit said oil collected therein to flow out of said interior space.

23. A piston according to claim 22, wherein said collecting trough means is provided with openings at its outer circumference for an aimed-at application of the oil collected in the collecting trough means against a wall of a cylinder.

24. A piston according to claim 22, wherein said supplying means includes at least one spray nozzle.

25. A piston according to claim 24, wherein said spray nozzle is positioned so as to extend through an opening in said collecting trough.

* * * * *